US008667723B2

(12) United States Patent
Bentley et al.

(10) Patent No.: US 8,667,723 B2
(45) **Date of Patent: *Mar. 11, 2014**

(54) DYNAMIC LATCH FOR A TUBE MOUNTED MAGAZINE WELL

(71) Applicant: Krow Innovation, LLC, Nampa, ID (US)

(72) Inventors: James K. Bentley, Eagle, ID (US); Ryan T. Cowgill, Fruitland, ID (US)

(73) Assignee: Krow Innovation, LLC, Nampa, ID (US)

( * ) Notice: Subject to any disclaimer, the term of this patent is extended or adjusted under 35 U.S.C. 154(b) by 61 days.

This patent is subject to a terminal disclaimer.

(21) Appl. No.: 13/735,621

(22) Filed: Jan. 7, 2013

(65) Prior Publication Data

US 2013/0125439 A1 May 23, 2013

Related U.S. Application Data

(62) Division of application No. 13/359,135, filed on Jan. 26, 2012, now abandoned, which is a division of application No. 13/020,733, filed on Feb. 3, 2011, now Pat. No. 8,104,209.

(51) Int. Cl.
*F41A 9/61* (2006.01)
*F41C 7/00* (2006.01)

(52) U.S. Cl.
USPC ..... 42/49.01; 42/6

(58) Field of Classification Search
USPC ..... 42/11, 17, 21, 24, 29, 33, 35, 37, 39, 42/49.01–50, 70.02; 89/197
See application file for complete search history.

(56) References Cited

U.S. PATENT DOCUMENTS

| | | | | |
|---|---|---|---|---|
| 465,339 | A | | 12/1891 | Browning et al. |
| 617,500 | A | | 1/1899 | Ehling |
| 1,350,619 | A | | 8/1920 | Payne |
| 1,433,945 | A | | 10/1922 | Eickhoff |
| 1,552,460 | A | * | 9/1925 | Young ..... 42/21 |
| 2,305,033 | A | | 12/1942 | Roemer |
| 2,454,613 | A | | 11/1948 | Peltier et al. |
| 2,494,159 | A | | 1/1950 | Bernstein |
| 2,710,476 | A | * | 6/1955 | Garand ..... 42/18 |
| 2,715,789 | A | * | 8/1955 | Garand ..... 42/50 |
| 2,980,456 | A | | 4/1961 | McMullin |
| 3,390,476 | A | * | 7/1968 | Vervier ..... 42/50 |
| 3,562,944 | A | | 2/1971 | Wagner |

(Continued)

OTHER PUBLICATIONS

Office Action issued in U.S. Appl. No. 12/612,910 mailed Dec. 14, 2010.

(Continued)

*Primary Examiner* — Bret Hayes
(74) *Attorney, Agent, or Firm* — Parsons Behle & Latimer

(57) ABSTRACT

A dynamic latch to selectively retain a magazine within the magazine port of a long gun. The dynamic latch permits the magazine to be inserted into the magazine port by movement in a single direction eliminating the need to rotate the magazine in order to secure it within the magazine port. The dynamic latch may include an outer housing, a piston positioned within the housing, and a spring positioned between the outer housing and the piston. A latch profile on the end of the piston may extend out of an opening in the end of a magazine well when the spring is in an uncompressed state.

17 Claims, 5 Drawing Sheets

(56) References Cited

U.S. PATENT DOCUMENTS

| | | | | | |
|---|---|---|---|---|---|
| 3,574,264 | A | * | 4/1971 | Simmons, Sr. | 42/6 |
| 3,636,647 | A | | 1/1972 | Goldin | |
| 3,715,826 | A | | 2/1973 | Seifried | |
| 4,047,821 | A | | 9/1977 | Hoke et al. | |
| 4,056,038 | A | * | 11/1977 | Rath | 89/128 |
| 4,127,954 | A | | 12/1978 | Hausmann | |
| 4,169,329 | A | | 10/1979 | Atchisson | |
| 4,297,800 | A | | 11/1981 | Atchisson | |
| 4,580,363 | A | | 4/1986 | Rowe, Jr. | |
| 5,027,541 | A | * | 7/1991 | Velezis | 42/18 |
| 5,253,442 | A | | 10/1993 | Kim | |
| 5,473,834 | A | | 12/1995 | Bammate | |
| 5,588,338 | A | | 12/1996 | Carr et al. | |
| 5,685,101 | A | | 11/1997 | Ferretti | |
| 5,771,620 | A | | 6/1998 | Crawford et al. | |
| 6,131,928 | A | | 10/2000 | Tung | |
| 6,854,916 | B2 | | 2/2005 | Hsieh | |
| 7,762,739 | B2 | | 7/2010 | Blanchard | |
| 8,104,209 | B1 | * | 1/2012 | Bentley et al. | 42/49.01 |
| 2007/0003361 | A1 | | 1/2007 | Wang | |
| 2008/0127539 | A1 | | 6/2008 | Schaffer | |
| 2009/0107023 | A1 | | 4/2009 | Murphy | |
| 2012/0198743 | A1 | | 8/2012 | Bentley et al. | |

OTHER PUBLICATIONS

Office Action issued in U.S. Appl. No. 12/612,910 mailed Apr. 6, 2010.

Office Action issued in U.S. Appl. No. 12/612,910 mailed Jul. 20, 2011.

Office Action issued in U.S. Appl. No. 13/359,135 mailed Apr. 26, 2012.

Office Action issued in U.S. Appl. No. 13/359,135 mailed May 10 2012.

Office Action issue in U.S. Appl. No. 13/359,135 mailed Oct. 3, 2012.

Office Action issue in U.S. Appl. No. 13/020,733 mailed Jun. 27, 2011.

* cited by examiner

DYNAMIC LATCH FOR A TUBE MOUNTED MAGAZINE WELL

RELATED APPLICATION DATA

This application is a divisional of U.S. patent application Ser. No. 13/359,135, filed Jan. 26, 2012, and entitled "Dynamic Latch for a Tube Mounted Magazine Well," which is a divisional of U.S. patent application Ser. No. 13/020,733, filed Feb. 3, 2011, and entitled "Dynamic Latch for a Tube Mounted Magazine Well," issued as U.S. Pat. No. 8,104,209, the disclosures of which are hereby incorporated by reference in their entirety.

BACKGROUND OF THE INVENTION

1. Field of the Invention

The present disclosure generally relates to a dynamic latch for selectively retaining an ammunition magazine in a magazine port of a long gun. Specifically, the dynamic latch selectively retains a magazine within a magazine port of a shotgun that is mounted on a magazine tube and permits the magazine to be inserted into the magazine port by movement in a single, linear direction. The dynamic latch eliminates the need to rotate the magazine to secure the magazine within the magazine port. The dynamic latch may also eliminate the need to add a magazine well to the shotgun receiver or long gun receiver. The dynamic latch may be used with a standard shotgun receiver.

2. Description of the Related Art

In the field of firearms, there is a need to improve the shell carrying capacity for long guns, including shotguns. One type of repeating shotgun is a pump-action shotgun. An example of a prior art pump-action shotgun 100 is shown in FIG. 1. The pump-action shotgun 100 includes a receiver 110 into which a magazine tube 190 and a barrel 195 may be inserted. The receiver 110 of the shotgun 100 is the main component that houses the chamber and firing mechanism. The magazine tube 190 is a tube that generally runs parallel underneath the barrel 195 of the shotgun and that can hold shotgun shells. The number of shells that the magazine tube 190 is capable of holding is constrained to its length. Five shells is often the maximum number of shells that a magazine tube 190 can hold. The end of the magazine tube 190 that is inserted into the receiver 110 usually includes exterior threads 191 so that the magazine tube 190 can be secured to a threaded opening 111 of the receiver 110 (best shown in FIG. 2).

The barrel 195 of the pump-action shotgun 100 is inserted into an upper opening 112 in the receiver 110 and includes a lug 196 that slides onto the front end (the far end from the receiver 110) of the magazine tube 190. Alternatively, the lug 196 may be included on the magazine tube. The front end of the magazine tube 190 includes threads 192, shown in FIG. 1, so that a nut (not shown) may be threaded onto the magazine tube 190 securely against the lug 196. The nut threaded against the lug 196 retains the end of the barrel 195 within the receiver 110. The pump-action shotgun 100 includes a pump grip 193 that is adapted to travel along the magazine tube 190. As is known to one of ordinary skill in the art, the pump grip 193 may be cycled to actuate a carriage (not shown) to load a shell from the magazine tube 190 into the chamber and properly position the bolt.

The introduction of the detachable shotgun magazine may increase the carrying capacity of a shotgun 200, as shown in FIG. 3, which is a side view of a typical shotgun that includes a receiver 210, a barrel 295 connected to the receiver 210, and a magazine 280. The shotgun 200 also includes a tube 290 connected to the receiver 210. The shotgun magazine 280 includes a tab or locking profile 281 that engages a corresponding structure within a magazine port 213 of the receiver 210, as best shown in FIG. 4. The corresponding profile is typically a static latching structure 282, such as another tab or complementary recess. Typically, to lock the magazine 280 into the magazine port 213, the operator first must align the locking profile 281 with the static latching structure 282. Once aligned, the magazine 280 may be rotated about the static latching structure 282 to engage a second locking structure 286, positioned on the magazine 280, with a rear locking profile 287 corresponds to a release lever 285. When the magazine 280 is locked into the magazine port 213, the release lever 285 may be actuated to release the magazine 280 from the receiver 210.

As illustrated by FIG. 3, the user of the shotgun may be unable to view the mating of the locking profile 281 with the static latching structure 282 (shown in FIG. 4) while inserting the magazine 280, which may lead to misalignment prior to rotating the magazine 280 to engage the second locking profile 286 of the magazine 280 with the rear locking profile 287 that is connected to the release lever 285. The requirement to align the locking profile 281 with the static latching structure 282, and then rotate the magazine 280 to engage the second locking profile 286 may cause a user to improperly insert the magazine 280 into the magazine port 213. For example, if the locking profile 281 is not properly aligned with the static latching structure 282, the second locking profile 286 may fail to properly lock the magazine 280 into the magazine port 213. Failure to achieve a proper lock may cause the magazine 280 to slide out of the magazine port 213 when it is rotated to engage the second locking profile 286 within the magazine port 213. Additionally, proper insertion and loading of the magazine 280 may be especially problematic in high pressure situations, such as in combat.

The addition of a magazine well (not shown) to the magazine port 213 may help to prevent misalignment when a magazine 280 is inserted into the magazine port 213 of a shotgun 200. However, the inclusion of a magazine well typically prevents the use of a standard shotgun receiver 210, requiring additional manufacturing costs. A magazine well typically provides a channel for the alignment of the magazine 280 as it is inserted into the magazine port with the rear locking profile 287 of the release lever 285 securing the magazine 280 within the magazine port 213 and magazine well.

The present disclosure is directed to overcoming, or at least reducing the effects, of one or more of the issues set forth above.

SUMMARY OF THE INVENTION

The following presents a summary of the disclosure in order to provide an understanding of some aspects disclosed herein. This summary is not an exhaustive overview, and it is not intended to indentify key or critical elements of the disclosure or to delineate the scope of the invention as set forth in the appended claims.

One embodiment of the present disclosure is a latch assembly comprising a body having a first end, a second end, and a cavity. The body is configured to be connected to a portion of a magazine well of a magazine tube assembly. The latch assembly includes a piston having a first end and a second end. The first end includes a latch profile configured to selectively engage a firearm magazine. The second end is at least partially positioned within the cavity of the body. The latch assembly includes a spring positioned between the piston and the body. A portion of the latch profile of the first end of the piston extends into the magazine well when the body is connected to the magazine well and when the spring is in an initial state.

The piston of the latch assembly may include a cavity and the spring may be positioned at least partly within this cavity. The body of the latch assembly may be configured to connect to a wall of the magazine well with one or more fasteners. The magazine well may include a rear locking profile connected to a lever. The lever may be pivotally connected to the magazine well. The rear locking profile may be integral to the lever. The latch profile of the latch assembly is configured to selectively engage a locking profile on a shotgun magazine. The latch profile may be adapted to engage a shoulder on the locking profile of the magazine, which prevents the removal of the shotgun magazine from the magazine well without rotating the shotgun magazine.

One embodiment of the present disclosure is a shotgun assembly including a tube configured to connect to a shotgun receiver and a pump grip configured to slide along the tube. The tube having a first end, a second end, and an opening on a side of the tube. The shotgun assembly includes a magazine well connected to the tube and aligned with the opening in the side of the tube. The magazine well has a first wall, a second wall, and a cavity that is configured to accept at least a portion of a shotgun magazine. The shotgun assembly includes a dynamic latch and a lever. The dynamic latch is connected to the first wall of the magazine well and the lever is connected to the second wall of the magazine well. The dynamic latch is configured to selectively secure a shotgun magazine within the magazine well.

The lever may include a rear locking profile that is adapted to engage a rear profile of the shotgun magazine. The lever may be pivotally attached to the magazine well being positioned opposite of the dynamic latch. The lever may be used to release the magazine from the magazine well. The dynamic latch may include a body, a spring, and a piston that includes a latch profile, which may be adapted to engage a front locking profile on a shotgun magazine. The magazine well may include one or more notches at the bottom of the magazine well, which may be configured to mate with one or more fins on the outside of a shotgun magazine. The latch profile may be adapted to engage a shoulder of a front locking profile on a shotgun magazine preventing the removal of the magazine from the magazine well by movement of the magazine in a single downward direction without rotating the magazine.

One embodiment of the present disclosure is a method of using a shotgun magazine that comprises inserting a shotgun magazine in a first linear direction into a magazine port of a shotgun tube assembly and engaging a latch profile with a top portion of the magazine. The method includes moving the latch profile away from the magazine to permit a first locking profile to move toward the latch profile and moving the latch profile back toward the magazine. The movement of the latch profile back towards the magazine causes the latch profile to engage the first locking profile to selectively retain the magazine within the magazine port.

One embodiment of the present disclosure is a shotgun magazine comprising a body including a first locking profile on a first side and a second locking profile on a second side opposite of the first side. The magazine includes at least one fin on an external surface of the body. The fin is configured to mate with at least one notch located in a bottom edge of a shotgun magazine well.

These and other embodiments of the present application will be discussed more fully in the description. The features, functions, and advantages can be achieved independently in various embodiments of the claimed invention, or may be combined in yet other embodiments.

Figure 1:
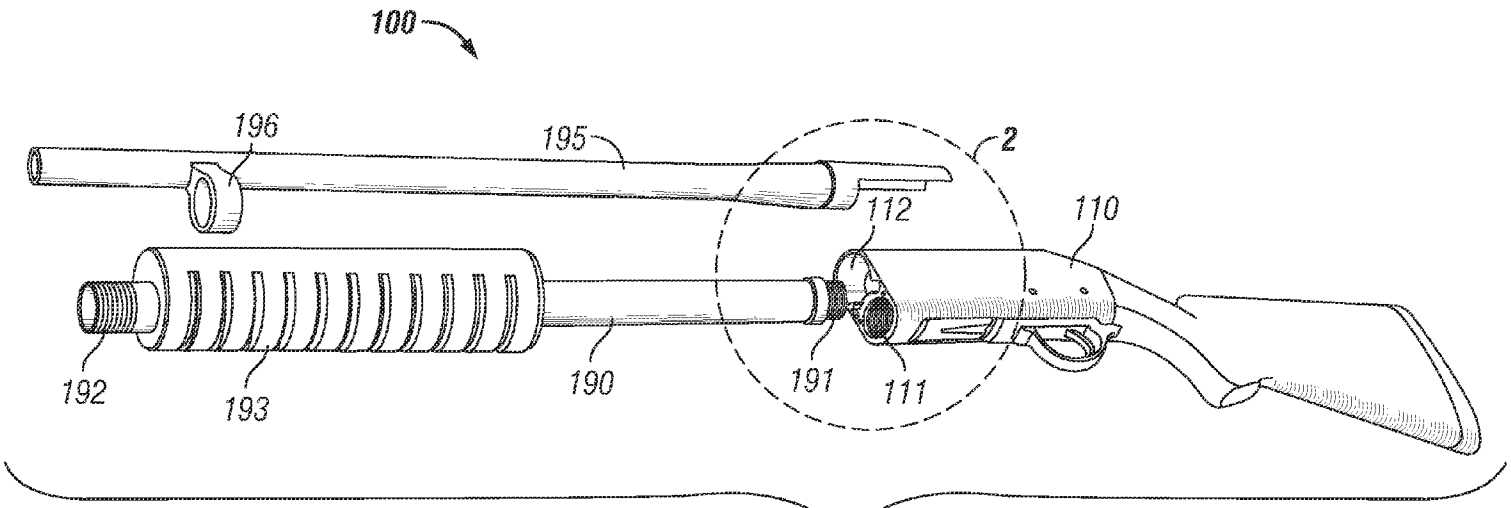
FIG. 1 (Prior Art)
FIG. 1 is an exploded view of some of the components of a prior art shotgun.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope as defined by the appended claims.

DESCRIPTION OF ILLUSTRATIVE EMBODIMENTS

Illustrative embodiments are described below as they might be employed in a dynamic latch for use with a shotgun receiver. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments will become apparent from consideration of the following description and drawings. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 5:
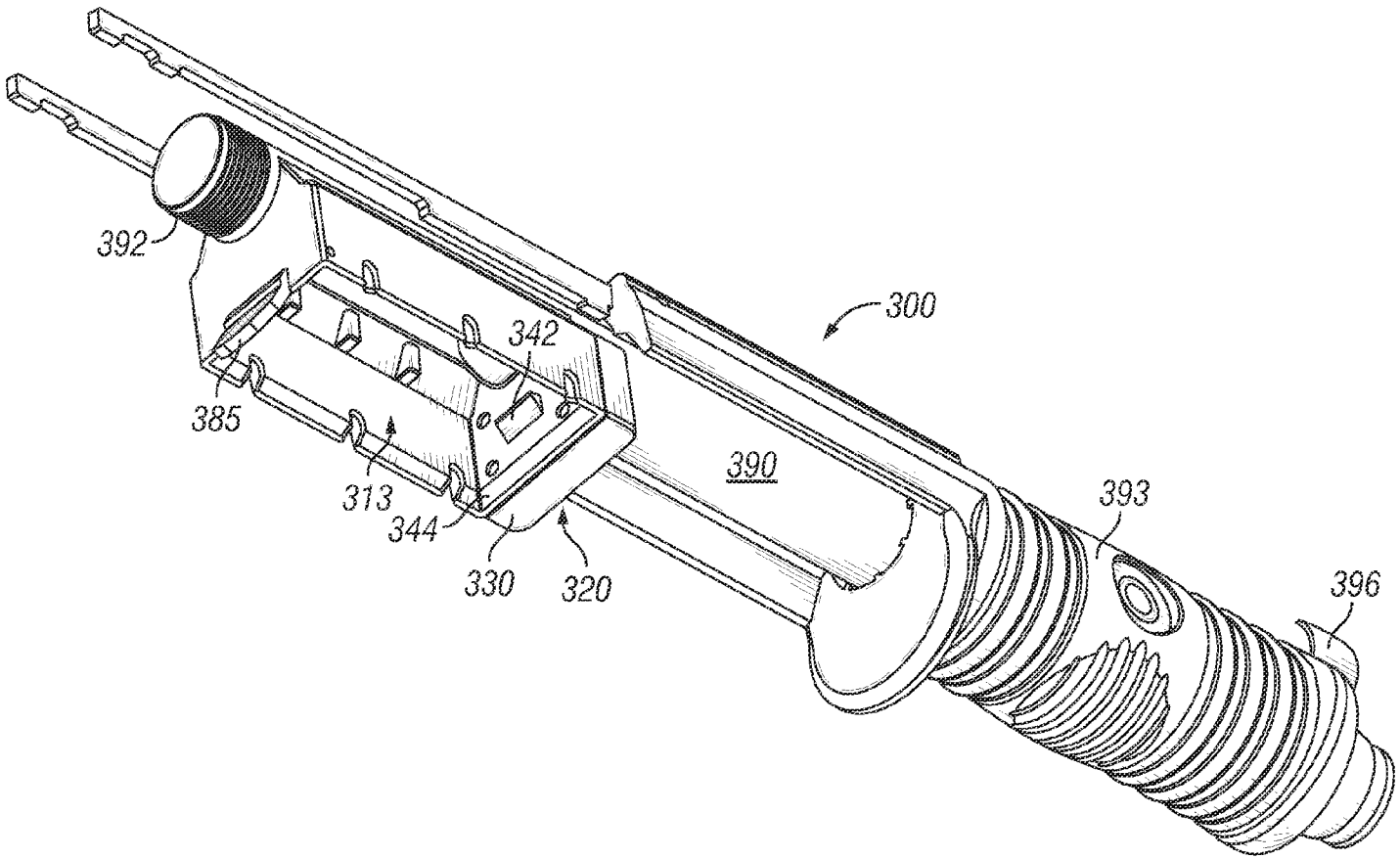
FIG. 5 is an isometric view of a tube assembly including a magazine port and an embodiment of a dynamic latch that may be used to selectively secure a magazine within the magazine port of the tube.

FIG. 5 shows an isometric view of an assembly 300 that may be connected to a standard shotgun receiver 110, such as, for example, by connecting the assembly 300 to threaded opening 111 of the standard shotgun receiver 110, the assembly 300 replacing the magazine tube 190 (shown in FIG. 1). The assembly 300 includes a tube 390 with a lug 396 at one end and a magazine well 313 attached to the tube 390 near a threaded end 392. Additionally, the assembly 300 includes an embodiment of a dynamic latch 320 connected to the magazine well 313 of the tube 390. The dynamic latch 320 may selectively retain a magazine 380 (shown in FIG. 7) within the magazine well 313 of the tube 390 in combination with a rear locking profile 387 connected to a dynamic lever 385. The lever 385 may be actuated to release the magazine 380 from the magazine well 313.

Figure 2:
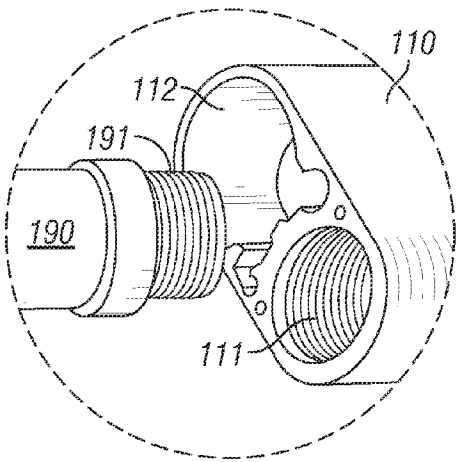
FIG. 2 (Prior Art)
FIG. 2 is a close up view of the receiver and the end of the magazine tube of the shotgun of FIG. 1.
Figure 3:
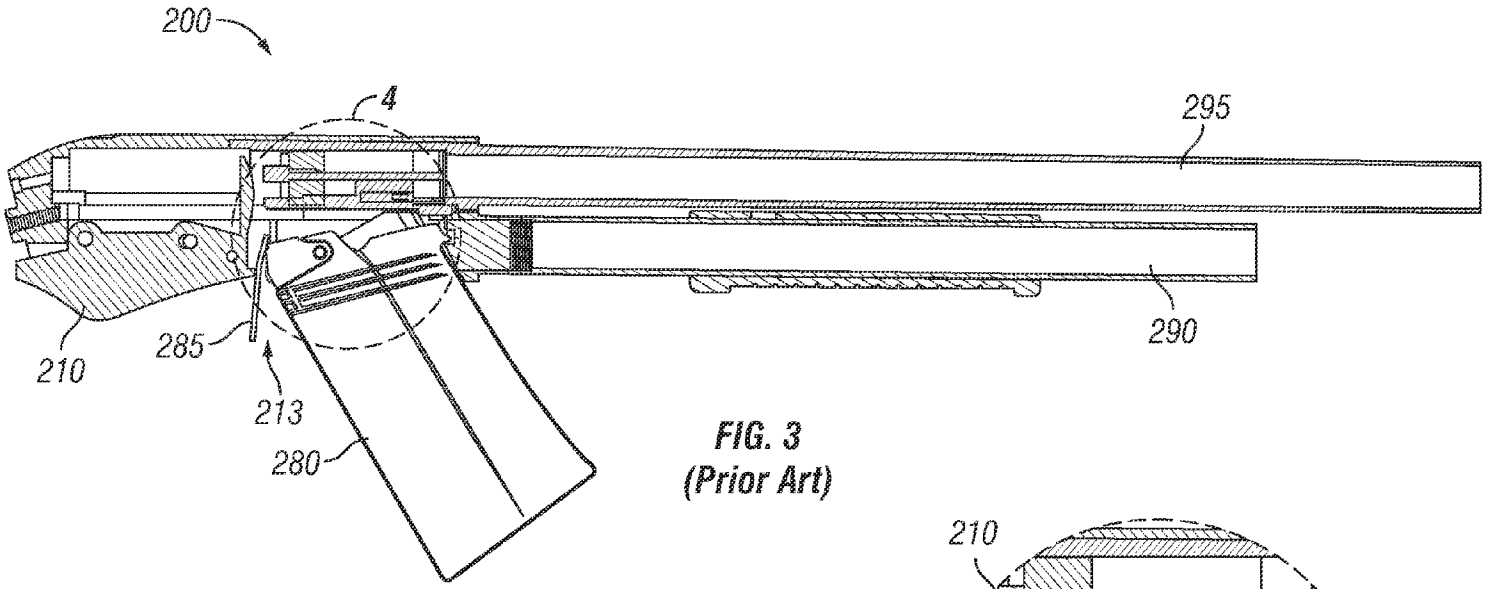
FIG. 3 (Prior Art)
FIG. 3 is a cross-sectional side view of a magazine being inserted into shotgun receiver having a static latch mechanism.
Figure 4:
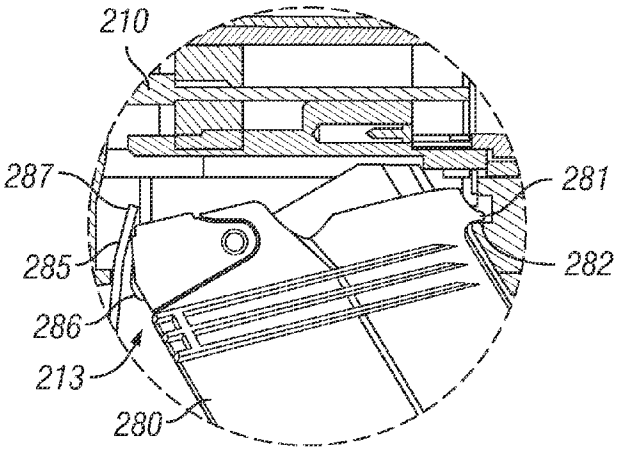
FIG. 4 (Prior Art)
FIG. 4 is a cross-sectional close up view of the locking profile of the magazine engaging the static latch mechanism shown in FIG. 3.

The dynamic latch 320 permits the insertion of the magazine 380 into the magazine well 313 in substantially a single linear direction. By contrast, the prior art latching mechanisms (see FIG. 2) first require alignment of the locking profile 281 with a static latching structure 282 and then rotation of the magazine 280 to engage the rear locking profile 287. As discussed above, if the locking profile 281 is not properly aligned with the static latching structure 282 prior to rotation, the magazine 280 may not properly lock within the magazine port 213. This may require repeated attempts for a user to properly secure the magazine 280 within the magazine port 213. This may be problematic in stressful situations, such as in combat. The dynamic latch 320 potentially prevents this problem by eliminating the need to rotate the magazine 380 to secure it within the magazine well 313.

Figure 6:
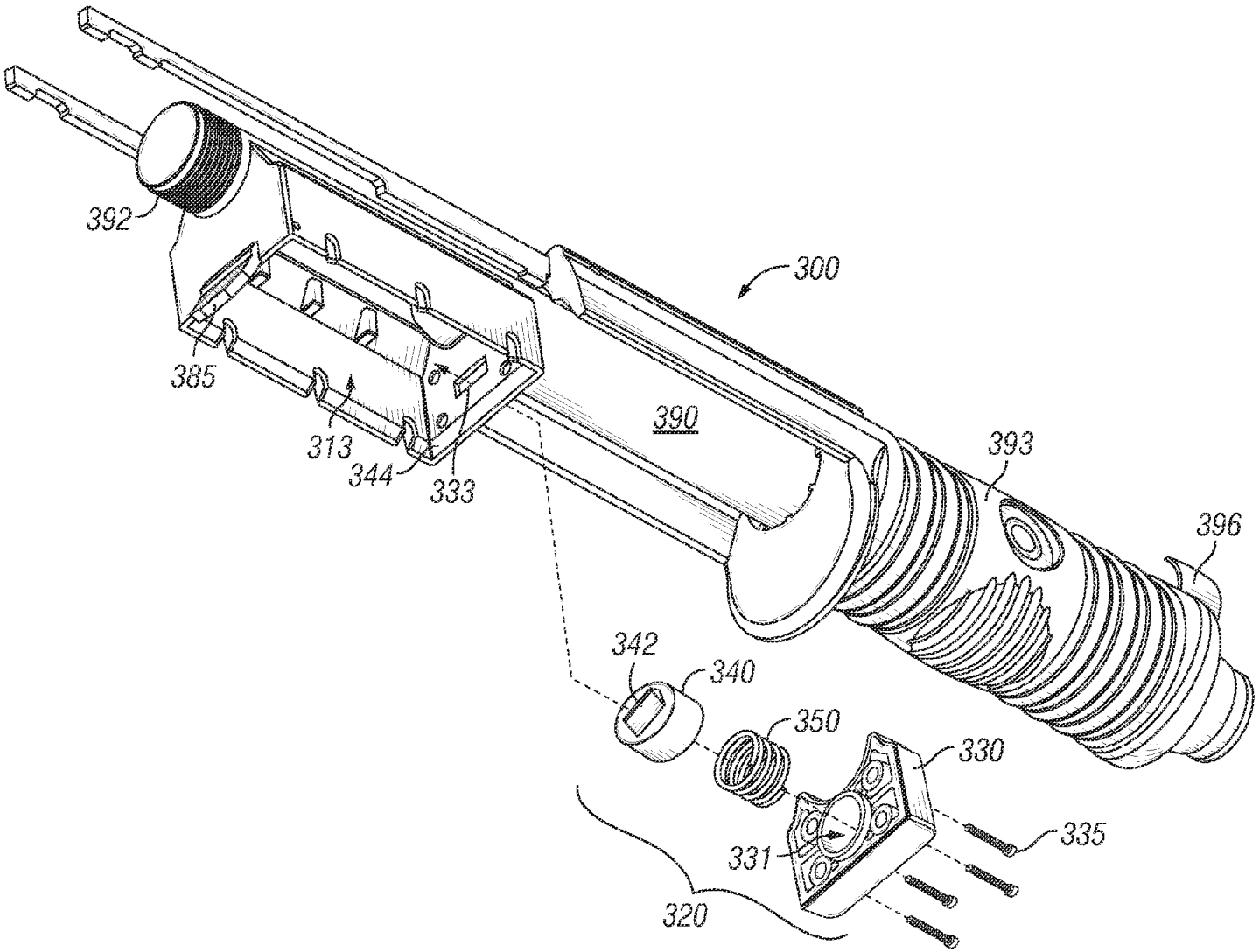
FIG. 6 is an isometric view of the tube assembly of FIG. 5 with an exploded view of the dynamic latch.

FIG. 6 is an isometric view of the assembly shown in FIG. 5 with an exploded view of the dynamic latch 320. The dynamic latch comprises an outer housing 330 that includes an inner cavity 331, a spring 350 that may be positioned within the inner cavity 331, a piston 340 that includes a latch profile 342, and fasteners 335 that secure the outer housing 330 to a latch wall 344 of the magazine well 313. The latch wall 344 comprises an opening 333 through which the latch profile 342 may extend, as shown in FIG. 5.

Figure 7:
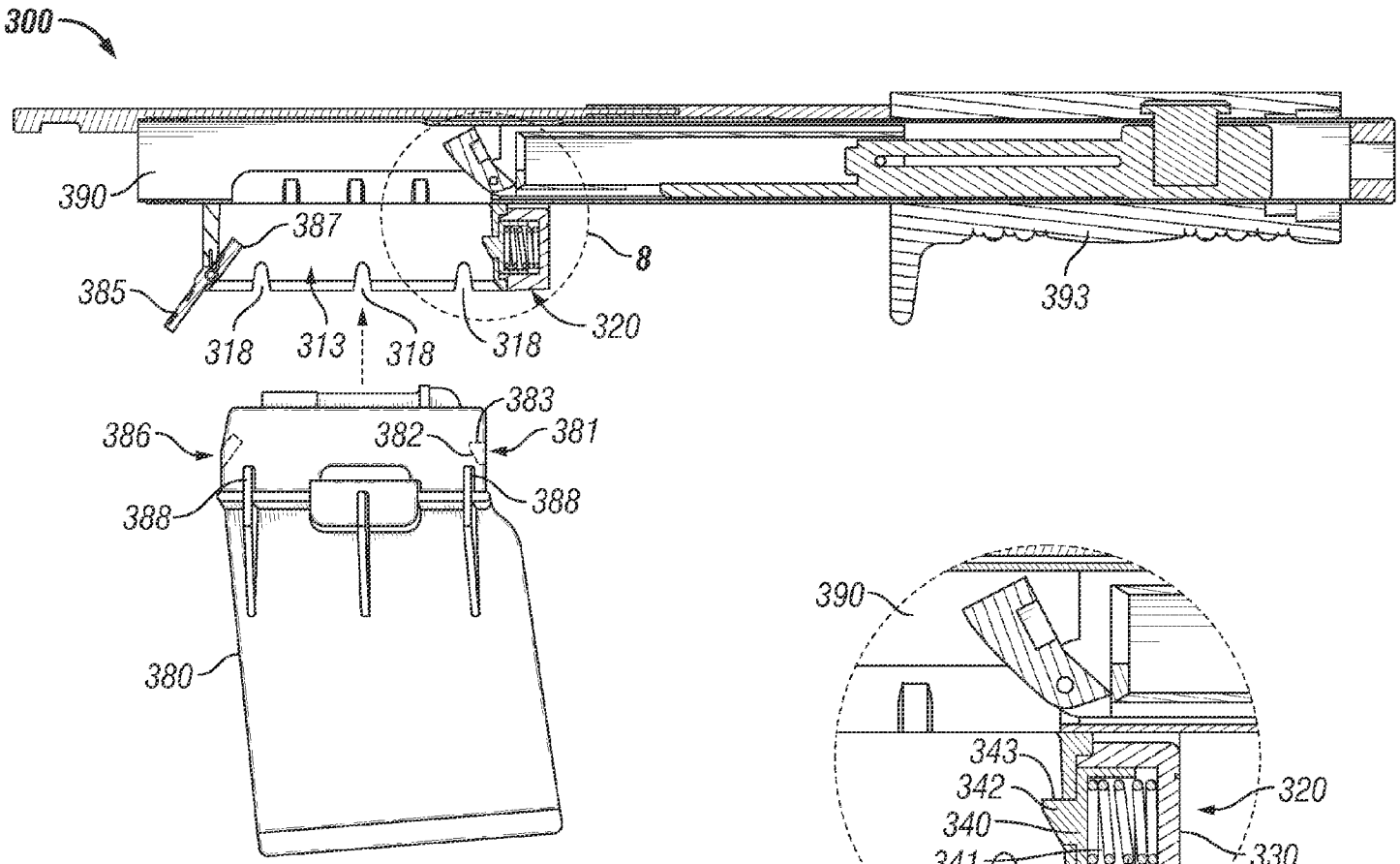
FIG. 7 is a side cross-sectional view of the assembly of FIG. 5 including the dynamic latch.

FIG. 7 is a side cross-section view of the assembly 300 showing, among other things, the pump grip 393, the tube 390, the release lever 385, the magazine well 313, and the dynamic latch 320. Additionally, the magazine 380 is shown below the assembly in a position that may allow the magazine 380 to be inserted into the magazine well 313 in substantially a single linear direction.

Figure 8:
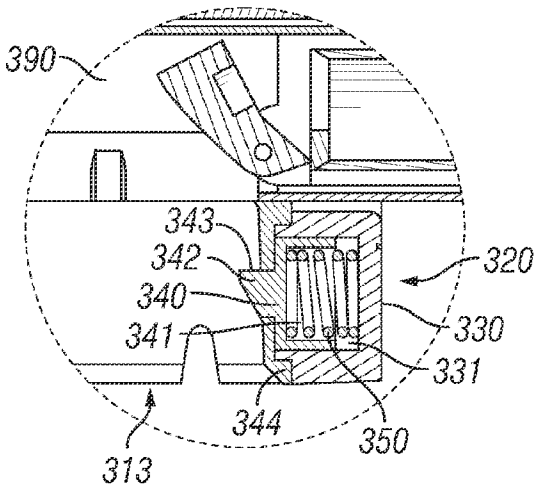
FIG. 8 is a close up cross-section view of the dynamic latch of FIG. 7.

FIG. 8 is a close up cross-section view showing the dynamic latch 320. The piston 340 is positioned within the inner cavity 331 of the outer housing 330 (best shown in FIG. 6). The spring 350 is positioned between the outer housing 330 and the piston 340, also within the inner cavity 331. As shown in FIG. 8, in some embodiments the piston 340 may comprise a spring cavity 341, within which the spring 350 may be positioned. The spring 350 may be configured to be in a substantially uncompressed state, when assembled within the dynamic latch 320. The piston 340, spring 350, and housing 330 are configured so that the latch profile 342 of the piston 340 protrudes out of the opening 333 when the spring 350 is in the substantially uncompressed state.

As shown in FIG. 7, the magazine 380 may be inserted with a substantially linear motion, up and into the magazine well 313 of the assembly 300, without rotating the magazine 380. As the magazine 380 is inserted into the magazine well 313 of the assembly 300, the locking profile 381 engages the latch profile 342. The movement of the magazine 380 will cause the top of the magazine 380 to push against the latch profile 342 compressing the spring 350 moving the piston 340 away from magazine 380. The movement of the piston 340 permits the locking profile 381 to move past the latch profile 342 into the loaded position within the magazine well 313. Once the top of the magazine 380 has moved past the latch profile 342, the spring 350 will return to the substantially uncompressed state, moving the piston 340 outward so that the latch profile 342 engages the locking profile 381, thus securing the magazine 380 in the magazine well 313.

As can be seen in FIG. 7, some embodiments of the magazine well 313 may comprise notches 318 at the bottom of the magazine well 313. The notches 318 complement fins 388 that may be formed into the magazine 380. When the magazine 380 is inserted into the magazine well 313, the fins 388 will mate with the notches 318 and provide lateral strength. For example, the fins 388, when mated with the notches 318, may prevent an unintentional actuation of the dynamic latch during a discharge event. In some embodiments, a different number of notches 318 and/or fins 388 than is shown in FIG. 7 may be used, as would be apparent to one of ordinary skill in the art, given the benefit of this disclosure.

The dynamic latch 320 permits the magazine 380 to be locked in the magazine well 313 by movement in substantially a single linear direction rather than requiring the alignment and rotation required to load prior long gun magazine mechanisms, such as the shotgun magazine latches discussed above. When unloading the magazine 380 from the magazine well 313, the release lever 385 may be actuated, releasing the second locking profile 386 of the magazine 380 from the rear locking profile 387. The magazine 380 may then be rotated about the latch profile 342 to disengage the locking profile 381 from the latch profile 342, thus releasing the magazine 380 from the magazine well 313.

The locking profile 381 on the magazine 380 may be adapted to prevent the removal of the magazine 380 from the magazine well 313 absent the actuation of the release lever 385, which rotates the magazine 380 out of the magazine well 313. For example, the locking profile 381 may include a tapered portion 382 and a shoulder 383, which may be at a 90 degree angle with the exterior surface of the magazine 380. The tapered portion 382 may be adapted to correspond with the shape of the latch profile 342 and the shoulder 383 may be adapted to mate with a corresponding surface 343 on the latch profile 342, which prevents removing the magazine 380 by a single downward movement once it is latched within the magazine well 313. The shoulder 383 and corresponding surface 343 on the latch profile 342 prevents the locking profile 381 of the magazine 380 from moving downward past the latch profile 342. The shoulder 383 and corresponding surface 343 causes the dynamic latch to be a single directional latch instead of being bi-directional. The dynamic latch 320 permits the insertion of the magazine 380 in a single direction, but does not release the magazine 380 by movement in the opposite single direction. Instead, the magazine 380 must be rotated about the latch profile 342 by the actuation of the release lever 385 to release the magazine 380 as discussed above.

Although various embodiments have been shown and described, the invention is not so limited and will be understood to include all such modifications and variations as would be apparent to one skilled in the art. For example, equivalent elements may be substituted for those specifically shown and described, certain features may be used independently of other features, and the number and configuration of various vehicle components described above may be altered, all without departing from the spirit or scope of the invention as defined in the appended claims.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A method of using a shotgun magazine comprising:

using a shotgun magazine with a body including:

a first locking profile located on a first side of the body and a second locking profile located on a second side of the body, the first side being positioned opposite the second side; and at least two fins on an external surface of a lateral side of the body between the first side and the second side and at least two other fins on an external surface of another lateral side of the body opposite the lateral side and also between the first side and the second side;

inserting the shotgun magazine into a shotgun magazine well;

engaging a latch profile in the magazine well with a top portion of the shotgun magazine;

moving the latch profile away from the shotgun magazine to permit the first locking profile to move toward the latch profile;

moving the latch profile back toward the shotgun magazine, the latch profile engaging the first locking profile and selectively retaining the shotgun magazine within the magazine well; and mating the fins with respective notches located in a bottom edge of the magazine well.

2. The method of claim 1, further comprising preventing unintentional removal of the body from the magazine well by the fins mating with the notches.

3. The method of claim 1, further comprising providing lateral strength to the shotgun magazine by the fins mating with the notches.

4. The method of claim 1, wherein mating the fins comprises releasably mating the fins with the notches.

5. The method of claim 1, wherein the magazine well is connected to a receiver of a shotgun.

6. The method of claim 1, further comprising inserting the shotgun magazine into the shotgun magazine well in an insertion direction, the fins having a height extending from the external surfaces, a length along a direction parallel with the insertion direction, and a width less than the length.

7. A method of using a magazine comprising:

using a magazine with a body including:

a first locking profile located on a front side of the body and a second locking profile located on a rear side of the body; and at least one fin on an external surface of a first lateral side of the body between the front side and the back side and at least one fin on an external surface of a second lateral side of the body opposite the first lateral side and also between the front side and the back side;

inserting the magazine into a magazine well in an insertion direction, the fins having a height extending from the external surfaces, a length along a direction parallel with the insertion direction, and a width less than the length;

engaging a latch profile in the magazine well with a top portion of the magazine;

moving the latch profile away from the magazine to permit the first locking profile to move toward the latch profile;

moving the latch profile back toward the magazine, the latch profile engaging the first locking profile and selectively retaining the magazine within the magazine well; and mating the fins with respective notches located in a bottom edge of the magazine well.

8. The method of claim 7, wherein inserting the shotgun magazine into the magazine well is done without rotation of the magazine about the latch profile.

9. The method of claim 7, wherein moving the latch profile away from the magazine comprises compressing a spring, and wherein moving the latch profile back toward the magazine comprises decompressing the spring.

10. The method of claim 7 further comprising engaging a second locking profile with the magazine, the second locking profile being connected to a lever.

11. The method of claim 10 further comprising moving the lever to disengage the second locking profile from the magazine.

12. The method of claim 11 further comprising rotating the magazine about the latch profile to remove the magazine from the magazine port.

13. The method of claim 7, further comprising preventing unintentional removal of the body from the magazine well by the fins mating with the notches.

14. The method of claim 7, further comprising providing lateral strength to the magazine by the fins mating with the notches.

15. The method of claim 7, wherein mating the fins comprises releasably mating the fins with the notches.

16. The method of claim 7, wherein the magazine well is connected to a receiver of a shotgun.

17. The method of claim 7, wherein the at least one fin on the external surface of the first lateral side comprises at least two fins and the at least one fin on the external surface of the second lateral side comprises at least two fins.

* * * * *

UNITED STATES PATENT AND TRADEMARK OFFICE

CERTIFICATE OF CORRECTION

PATENT NO. : 8,667,723 B2
APPLICATION NO. : 13/735621
DATED : March 11, 2014
INVENTOR(S) : James Bentley and Ryan T. Cowgill It is certified that error appears in the above-identified patent and that said Letters Patent is hereby corrected as shown below:

In the Claims

Col. 8, line 18, claim 8 should read as follows:

8. The method of claim 7, wherein inserting the magazine into the magazine well is done without rotation of the magazine about the latch profile.

Signed and Sealed this
Sixth Day of May, 2014

Michelle K. Lee

Michelle K. Lee
*Deputy Director of the United States Patent and Trademark Office*